US007135684B1

(12) United States Patent
Campbell

(10) Patent No.: US 7,135,684 B1
(45) Date of Patent: Nov. 14, 2006

(54) ROTATIONAL-TRANSLATIONAL FOURIER IMAGING SYSTEM REQUIRING ONLY ONE GRID PAIR

(75) Inventor: Jonathan W. Campbell, Harvest, AL (US)

(73) Assignee: United States of America as represented by the Administrator of the National Aeronautics and Space Administration, Washington, DC (US)

( * ) Notice: Subject to any disclaimer, the term of this patent is extended or adjusted under 35 U.S.C. 154(b) by 93 days.

(21) Appl. No.: 11/116,167

(22) Filed: Apr. 21, 2005

(51) Int. Cl.
*G21K 1/22* (2006.01)

(52) U.S. Cl. ..... 250/363.1

(58) Field of Classification Search ..... 250/363.1
See application file for complete search history.

(56) References Cited

U.S. PATENT DOCUMENTS 5,432,349 A 7/1995 Wood et al.
5,625,192 A 4/1997 Oda et al.
5,838,757 A 11/1998 Vartanian
6,445,772 B1 9/2002 Campbell
6,703,620 B1 3/2004 Campbell
6,816,247 B1 * 11/2004 Heppner et al. ..... 356/124

* cited by examiner

*Primary Examiner*—David Porta
*Assistant Examiner*—Marcus Taningco
(74) *Attorney, Agent, or Firm*—James J. McGroary; Norman L. Wilson, Jr.

(57) ABSTRACT

The sky contains many active sources that emit X-rays, gamma rays, and neutrons. Unfortunately hard X-rays, gamma rays, and neutrons cannot be imaged by conventional optics. This obstacle led to the development of Fourier imaging systems. In early approaches, multiple grid pairs were necessary in order to create rudimentary Fourier imaging systems. At least one set of grid pairs was required to provide multiple real components of a Fourier derived image, and another set was required to provide multiple imaginary components of the image. It has long been recognized that the expense associated with the physical production of the numerous grid pairs required for Fourier imaging was a drawback. Herein one grid pair (two grids), with accompanying rotation and translation, can be used if one grid has one more slit than the other grid, and if the detector is modified.

12 Claims, 5 Drawing Sheets

ROTATIONAL-TRANSLATIONAL FOURIER IMAGING SYSTEM REQUIRING ONLY ONE GRID PAIR

CROSS-REFERENCE TO RELATED APPLICATIONS

There are no applications related to this application. However, reference is made to U.S. Pat. No. 6,703,620 granted to the inventor herein.

STATEMENT REGARDING FEDERALLY SPONSORED RESEARCH OR DEVELOPMENT

The invention described in this patent was made by an employee of the United States Government and may be manufactured and used by or for the Government for governmental purposes without the payment of any royalties.

FIELD OF THE INVENTION

In general, this invention pertains to hard X-ray, gamma ray, and neutron imaging. Specifically, this invention pertains to Fourier imaging systems, and to integrated systems utilizing this technology, and its use in instruments used in scientific, medical, industrial, and homeland defense imaging areas.

BACKGROUND OF THE INVENTION

The sky contains many active sources that emit X-rays, gamma rays, and neutrons such as our sun, radio galaxies, Seyfert galaxies, and quasars, as well as black holes, and clusters of galaxies. In addition to sources located in the heavens, many terrestrial applications are also associated with the penetrating characteristics of x-rays, gamma rays, and neutrons. Unfortunately hard X-rays, gamma rays, and neutrons cannot be imaged by conventional optics such as lenses or mirrors. As a result hard X-ray astronomy and other imaging applications were originally handicapped because of this lack of imaging capability. This led to the development of several innovative techniques including Fourier telescopes, one such telescope being the subject of U.S. Pat. No. 5,838,757. The theory and capability of Fourier telescopes is well understood. See the reference, "Imaging the Sun in Hard X-rays Using Fourier Telescopes" by J. W. Campbell, the inventor herein, found in NASA Technical Memorandum, NASA TM-108390 (January 1993). Fourier telescopes permit observations over a very broad band of energies that for photons range from the hard X-ray regime to very high energies up to and above several MeV. Depending upon the application, neutron sources across a wide band of high energies may also be imaged. For some applications, 1 eV neutrons may be sufficient while some applications may require imaging at energies up to and above 1 MeV to 100 MeV. In addition, complex sources emitting a mixture of these radiation types may be imaged simultaneously as well. These images may be integrated over all energy bands, or in one or more selected bands to aid in the understanding of the source characteristics. Thus a resulting integrated image may have a high spatial resolution as well as a high energy resolution.

In early approaches, multiple grid pairs were necessary in order to create rudimentary Fourier imaging systems. For example, 48 grids were used in a basic telescope design in Campbell, NASA TM-108390 at page 109. At least one set of grid pairs was required to provide multiple real components of a Fourier derived image, and another set was required to provide corresponding multiple imaginary components of the Fourier derived image. Image spatial resolution is limited by the widths of the grid slits (or slats). Requirements for better spatial resolution lead to exponential cost increases for grid fabrication and alignment.

It has long been recognized that the expense associated with the physical production of the numerous grid pairs required for its collimator was a primary constraint to achieving higher fidelity imaging. In addition, with imaging system aperture size often limited, improved sensitivity as opposed to higher fidelity and lower cost became an additional compromise. Thus, an innovative approach leading to a reduction in grid pairs and cost without sacrificing imaging sensitivity or fidelity was needed. This was accomplished in my U.S. Pat. No. 6,703,620 by creating Fourier derived images with only two grid pairs. The reduction to only two grid pairs needed for imaging was rendered possible by manipulating the grids through rotation and translation. Since a 24-grid pair Fourier imager can cost as much as ten times more than a two-grid imager to produce, the reduction in the number of grids is a significant reduction in cost. And, it was not believed that a one-grid pair Fourier imaging system was feasible because the first grid pair provides multiple real components necessary for a Fourier derived image, and the second grid pair provides corresponding multiple imaginary components for that Fourier derived image.

By this invention, a Fourier derived image can be generated in a system with only one grid pair. In U.S. Pat. No. 6,703,620 the possibility of utilizing only one grid pair was recognized and claimed. However, it was pointed out at the time that the single grid pair theory contemplated a collection of data at discrete, predetermined, points in the available spectrum based on estimating the imaginary component. Such guesswork leads to uncertainties in the accuracy of the final image and may actually result in a totally misleading image. For example, errors in a medical application such as the detection of breast cancer could go either way: (a) a tumor being undetected or (b) unnecessary surgery being indicated.

SUMMARY OF THE INVENTION

U.S. Pat. No. 6,703,620 is directed to reducing the number of grid pairs in the imaging of hard X rays, gamma rays, and high energy neutrons by Fourier imaging. Two grid pairs are manipulated by rotation and translation in a manner that allows (1) a first grid pair to provide multiple real components of the Fourier derived image and (2) a second grid pair to provide multiple imaginary components of the Fourier derived image. This enables only two grid pairs to provide the same imaging information from photons that has been traditionally collected with multiple grid pairs. It has now been found possible to enhance imaging fidelity by using only one grid pair (two grids), when they are adapted for rotation and translation, if one grid has one more slit than the other grid, and if the detector is modified. Considering one of the two grids to have an even number of (n) slits in a given width, the other grid is provided with (n+1) slits in the same width. In addition, the detector incorporated in the apparatus is provided with at least two segments or elements. When illuminated by the photons, the detector sends detailed photon impingement location information to the software for calculation of the image.

THE INVENTION

A Fourier imaging concept involves sampling selected Fourier components from a wave front emitted by an extended source. By measuring a number of discrete components over a sufficiently large spatial frequency spectrum, a matrix can be formed from which a Fourier surface can be approximated. A Fourier transform of this surface yields an approximate, or dirty, image. For many applications, the dirty image may be sufficient. However, several algorithms developed over the years have been found effective in cleaning the dirty image to produce a meaningful result. This will be understood by reference to a description of the apparatus in conjunction with the accompanying drawings.

THE DRAWINGS

FIG. 1 is a perspective view of the Rotational-Translational Fourier Imaging System which is the subject of U.S. Pat. No. 6,703,620.

DESCRIPTION OF AN EMBODIMENT OF THE INVENTION

Figure 1:
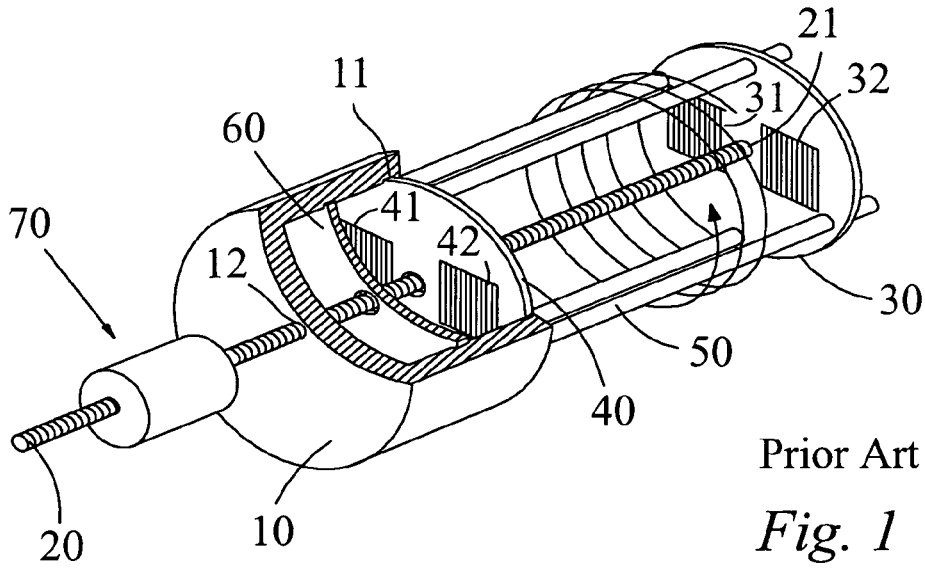
Prior Art Fig. 1

Since the invention herein is an improvement of the Fourier derived imaging system of U.S. Pat. No. 6,703,620, incorporated herein by reference, a description of this invention should begin with a explanation of that prior art apparatus. In FIG. 1 an imaging system is shown which utilizes four grids (31, 32) and (41, 42), generally referred to as two grid pairs. As can be seen, the instrument includes a frame (10), a drive rod (20), a first disk or plate (30), a second disk or plate (40), a detector (60), and a means for simultaneously rotating and translating the drive rod (70). Frame (10) includes a disk guide (11), which supports the second disk, and a rod guide (12), which supports the drive rod (20). The first disk or grid tray (30) is rotatably connected to an end (21) of the drive rod (20). This grid tray carries a first real grid (31) and a first imaginary grid (32). The second disk or grid tray (40) carries a second real grid (41) aligned with the first real grid (31), and a second imaginary grid (42) aligned with the first imaginary grid (32). The second disk (40) and the first disk (30) are rotatably connected through a plurality of connecting rods (50). The second disk (40) is rotationally guided by disk guide (11) in frame (10) when it is rotated by rods (50) as first disk (30) is rotated. As noted in my earlier patent, the means for simultaneously rotating and translating using the drive rod (20) can be accomplished in a variety of ways described in that patent. When the drive rod (20) is threaded and placed within a shaft, rotation and translation can be accomplished by various gear arrangements affording synchronized rotation of the second grid tray with the first grid tray. And translation can be in either direction. A detector is mounted at (60) in frame (10), and it is aligned with the real grid pair (31, 41) and the imaginary grid pair (32, 42) to act on the detected flux.

It remains, now, to discuss the operation of this two grid pair apparatus. By using four grids made up of slits and slats we have two (n, n) grid pairs wherein each pair of grids has the same number (n) of slits (actually, slits and slats). A wave front field of photons and/or neutrons emitted by a source can be adequately described upon arriving at the Fourier imaging system aperture by a Fourier transform of the object function f(x,y). This transform is a complex function F(u,v) made up of a real component and an imaginary component mentioned in conjunction with FIG. 1. The specific rotation and translation positions described hereinbefore provide specific intensity values for (u) and for (v) in each row of a matrix formed thereby. At a specific (u,v), the first (n,n) grid pair, in combination with its associated single grid detector, provides Real image measurements. In addition, at this specific (u,v), the second (n,n)' grid pair, in combination with a single element grid detector, provides Imaginary image measurements. Hence, by varying (u,v) through rotation and translation and taking associated (Real Image) measurements, a four by N matrix is produced. This matrix is required in order to obtain the image (N being the total number of (u,v) points as noted hereinbefore).

Figure 2:
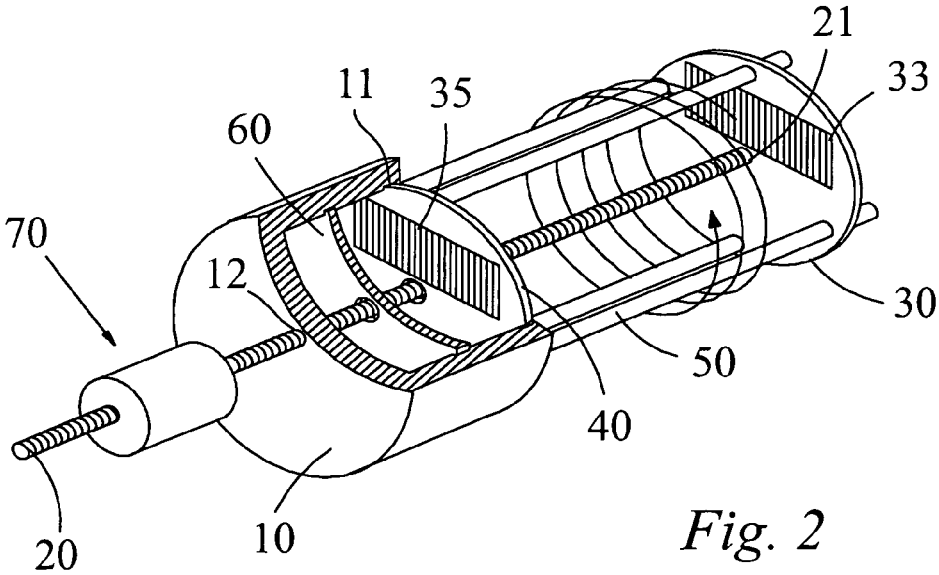
FIG. 2 is a perspective view of the improved Rotational-Translational Fourier Imaging System of this invention.

It can be seen that, previously for Fourier imaging, two grids (31, 41) have been used for the Real image and two grids (32,42) for the Imaginary image. It has now been found that comparable images can be obtained by the use of only two grids (one grid pair). Referring now to FIG. 2, two grids (33) and (35) are shown. In this invention, grid (35) (nearest the observer by convention) is provided with one more slit than grid (33). In addition detector (60), rather than being a single element detector, is modified to include at least two elements or segments. Thus one grid pair can be eliminated from FIG. 1 as shown in FIG. 2 when, instead of an (n,n) grid pair an (n, n+1) grid pair is used along with a multiple element detector. Generally four to seven elements are sufficient, but it can include as many as 101 elements, determined by fidelity requirements. By collecting data at multiple angular grid positions, and with multiple distances between the first grid and the second grid, an image can be produced as will be described further in the description of the preferred embodiment of the invention that follows.

PREFERRED EMBODIMENT OF THE INVENTION

Figure 3:
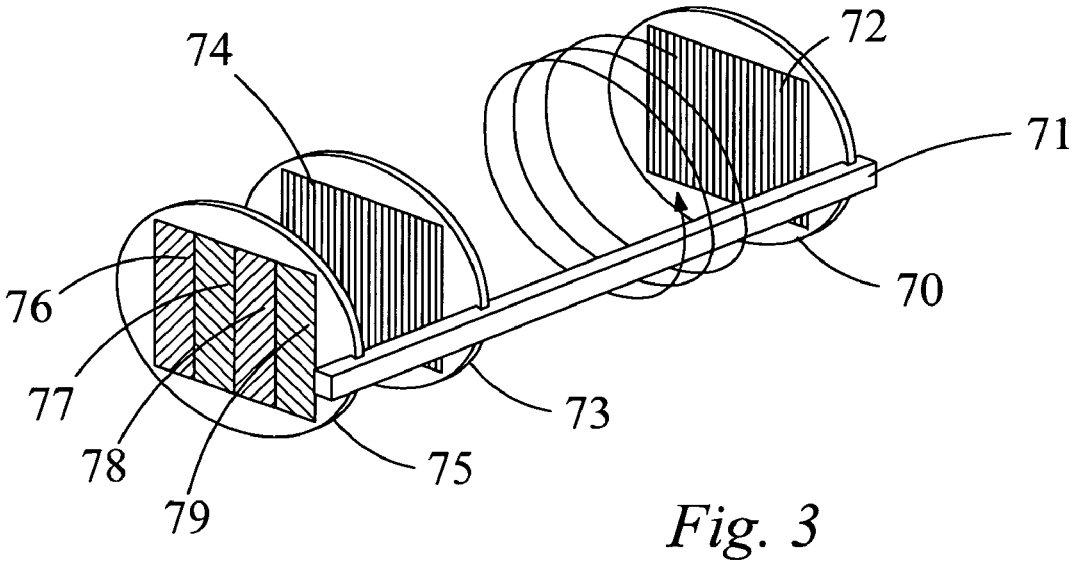
FIG. 3 is a diagrammatic representation of the preferred embodiment of the invention incorporating a side drive.

The preferred embodiment of the invention is diagrammatically illustrated in FIG. 3. As can be seen in this embodiment the translation-rotation drive mechanism (in housing 71) has been moved to the side of the unit. For this reason the FIG. 3 embodiment is preferred because the drive rod (20, FIGS. 1 & 2) does not interfere with the location of the grids as it does in FIG. 2. As illustrated in FIG. 3 larger grids (72) and (74) are possible, providing even greater sensitivity for the imaging system. The arrangement of the parts of the device can be more clearly visualized in this diagrammatic presentation. The outer grid plate/tray/disk (70) carries grid (72), and the inner (i.e., opposite) grid plate/tray/disk (73) supports grid (74). Which grid has an even number of (n) slits and which has an odd number of (n+1) slits does not affect the results so long as one grid has one more slit than the other grid over the same width. The center slit of each grid (or, more precisely, the center slit of the grid having an odd number of (n+1) slits and one of the two center slits of the grid having an even number of (n) slits) should be aligned with the center of the detector for best results. As can be seen, the grids are oppositely disposed and they will rotate and translate in those opposite positions by the drive mechanism to be described in conjunction with FIG. 4. The detector (75) is also shown in FIG. 3 and rotates with the grids. It is to be noted that it included two or more segments or elements (76), (77), (78), and (79). Even though the translation-rotation drive mechanism is somewhat more complex the advantages of a side drive outweigh the central drive shaft.

Figure 4:
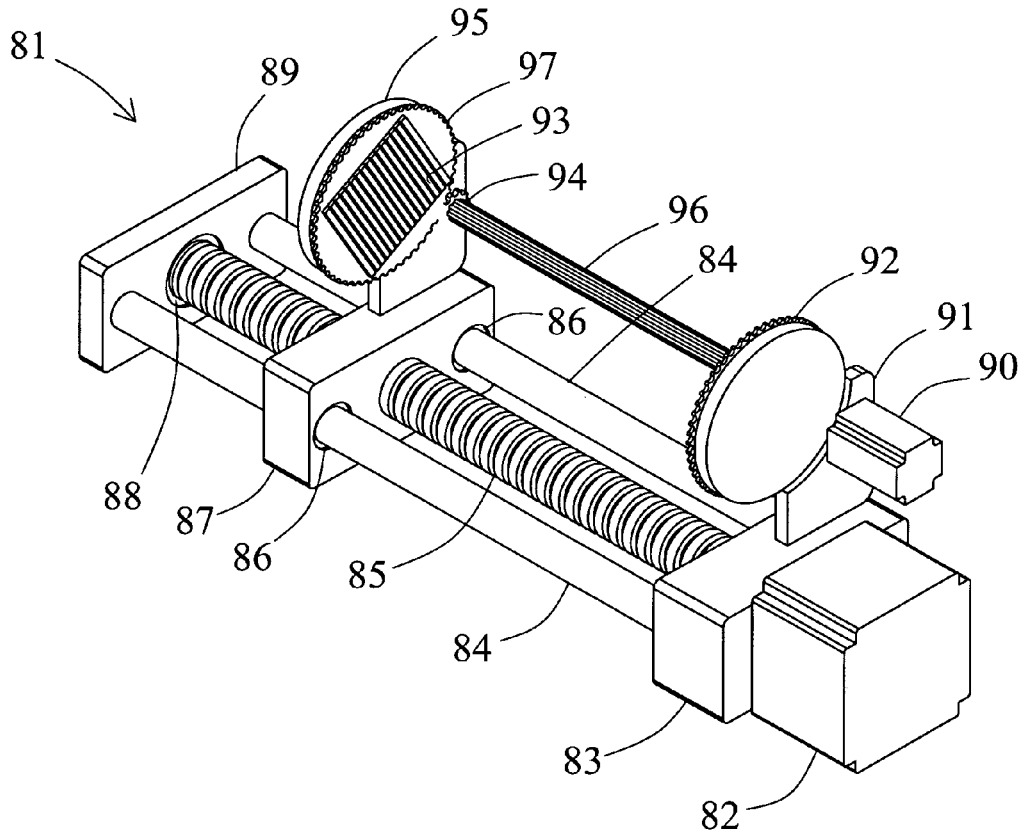
FIG. 4 is an isometric view showing the details of one possible side drive.

Referring now to FIG. 4, the side drive mechanism per se, the two grid plates/trays, (92) and (95) fabricated of a transparent material such as aluminum, and having integrated gear teeth (97), are shown. Rotation is accomplished by drive shaft (96) and drive gear (94) mounted in support bases (91) so that the two grid plates (92) and (95) rotate synchronously. To accomplish the simultaneous rotation necessary, a sub-fractional AC or DC servo motor (90) is used. Translation is achieved by precision lead screw or shaft (85) in combination with translating base (87) that carries recirculating ball bearing assemblies (86). Shaft (85) is rotated by a brushless motor (82), and the unit is stabilized by stationary precision ground shafts (84) and stationary end plates (83) and (89). The multiple-segment detector is not shown in FIG. 4, but it will be aligned as shown in FIG. 3.

Grid materials are used extensively in astronomy and need not be discussed at length herein. Desirable grid-slat materials are those that are highly absorptive when exposed to penetrating neutrons (e.g., beryllium), X-rays and Gamma Rays (e.g., tungsten or lead). Slits may be open or composed of a highly transparent material such as aluminum and glass. Likewise, detectors are well known, for instance, germanium detectors (GeD) which cover the entire hard X-ray to gamma ray line energy range (up to ~20 MeV) with the highest spectral resolution. Sodium iodide detectors are also well known. Photons interacting in a GeD detector generate charge pulses, which are collected and amplified by a transistor-reset amplifier to provide the best energy resolution and high-count rate performance.

Image reconstruction of astrophysical sources at hard X-ray or gamma-ray energies by nonfocusing telescopes has always been a challenge, largely due to an intrinsically low signal to noise ratio. This challenge can be met by the specific rotation and translation positions achieved by the apparatus of FIG. 4, which provide specific values for (u) and for (v) as previously indicated. The simultaneous rotation and translation allow data to be collected at multiple angular positions of the outer grid, and the inner grid, and multiple distances between the two grids. When detected using a multiple element detector, the values of (u) and (v), and the phase and amplitude of the radiation can be measured, yielding a real and imaginary data stream directly. With this data matrix and algorithms such as Astronomical Image Processing System (AIPS) the final image can be computed. In actuality there are many techniques for reconstructing dirty images in non-focusing telescopes, for instance, such as correlation and inversion. Various techniques are also employed to improve the quality of dirty images, such as the maximum entropy methods. The procedure herein will now be demonstrated using a coded grid imaging system as explained in following imaging tests and three-dimensional perspective plots.

Testing

Figure 5:
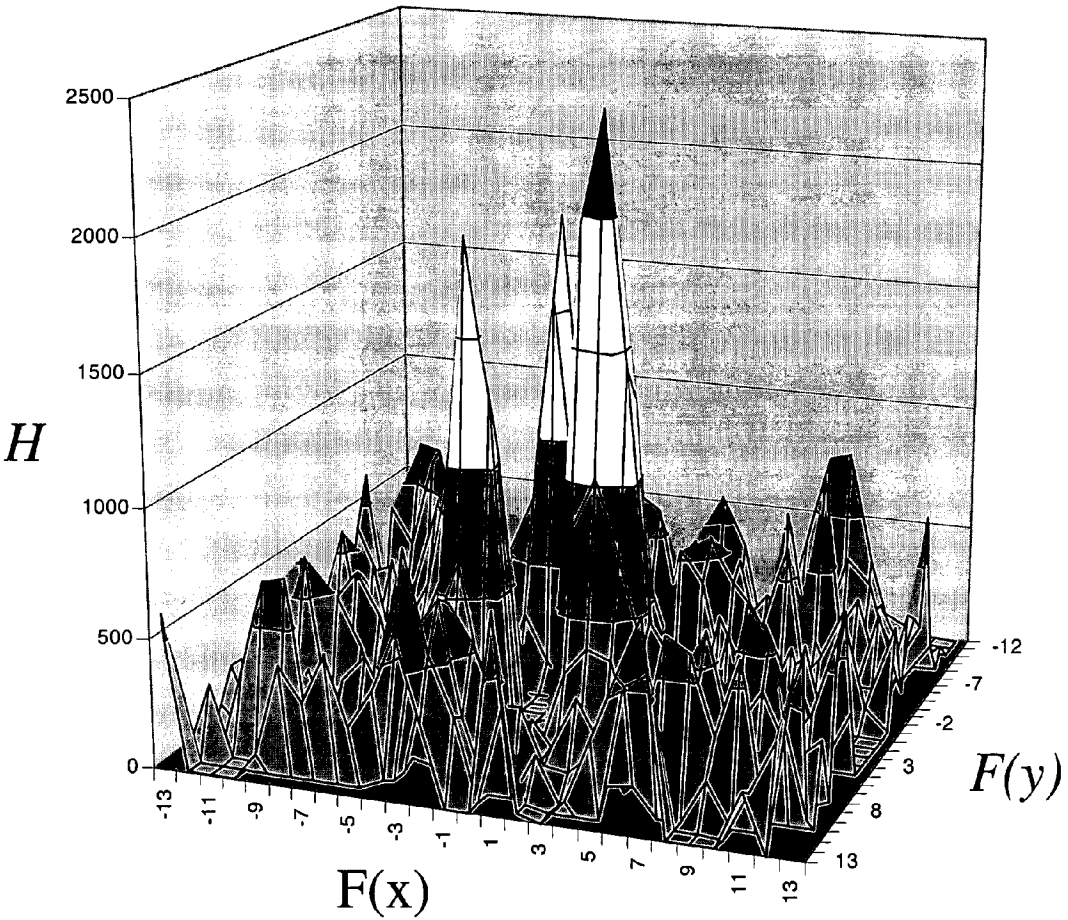
FIGS. 5 and 6 are three-dimensional plots which illustrate this invention by showing three dimensional, Fourier derived image representations based on multiple point source inputs.
Figure 6:
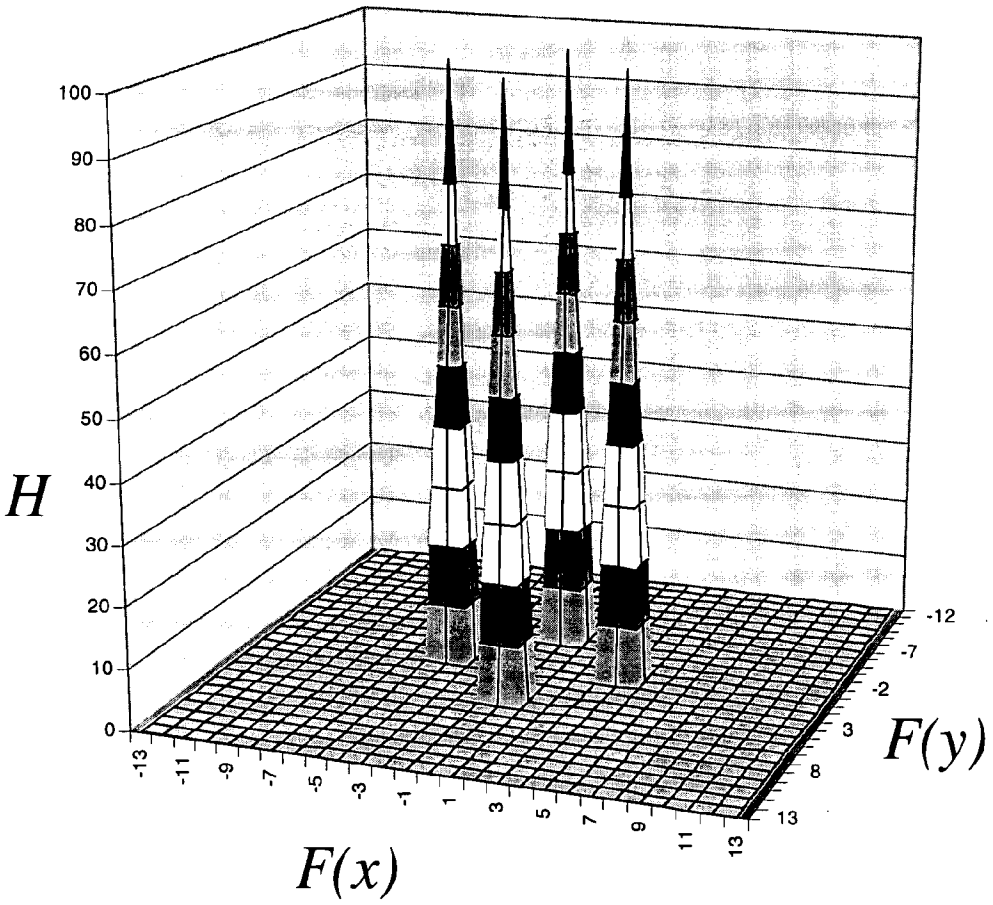

Testing through simulation is a powerful tool for these devices. Many tests have been performed and an example is shown as follows. The test herein involves finding an output response by the use of input extended sources in the object plane. FIGS. 5 and 6 are three-dimensional plots representing input sources producing a wavefront that may be described by a Fourier transform at the imaging system aperture. Shown in the prior art example of FIG. 5 are three point sources of different intensities. Shown in FIG. 6, the example of this invention, are four point sources of approximately the same intensity A two dimensional spatial frequency domain imaging algorithm is obtained by making suitable approximations to the point spread function and obtaining its Fourier transform. The effect of aberrations may be determined by optical transfer functions for focusing errors in a system with a rectangular grid opening. As can be seen in FIGS. 5 and 6, the figures are three-dimensional image plots of location x along one axis, location y along the other axis and intensity H along the z-axis.

Multiple component (grids, detectors, drive motors, etc.), subsystem, and breadboard tests have been accomplished over the years and this testing is continuing. In addition, simulation has been found to be a powerful tool in understanding, designing, and optimizing Fourier imaging systems. This is especially true for photon-by-photon simulations. As one example, the test herein involves finding an image of selected input point sources in the object plane. These sources are representative of those that can represent a medical, homeland defense, or industrial application. The effectiveness of this invention is illustrated by the diagrams shown in FIGS. 5 & 6 which are images of three and four point sources. FIG. 5, the prior art, illustrates the ability of an imaging system to accurately locate and represent simple sources of varying intensities. FIG. 6 illustrates the invention's capability of imaging simple sources even of approximately equal intensities. In both instances, during the observation, an image is obtained for every 180 degrees of rotation orientation relative to the source. The figures are three-dimensional plots of x location along one axis, y location along the other axis, and intensity H along the z-axis.

Test Results

Referring now specifically to FIGS. 5 and 6, the units in the x and y plane represent the location of the simulated test point sources' images in normalized units of length. The z plane shows intensity in normalized units for comparison purposes. The actual imaging of the sources is accomplished by imaging algorithms that have been verified both through computer simulations and experimental results. FIG. 5 shows that the image formation system of the prior art does not eliminate all the noise. This noise appears as small or weak virtual point sources seen at the base of the three desired point sources. In FIG. 6, illustrating this invention, those weak noise sources are greatly reduced and the four desired point sources are clearly visible.

It can be seen that by the practice of this invention noise is substantively reduced. In addition, image fidelity is improved by the invention. Imaging system performance in photon limited conditions thus can be greatly improved. Stated differently, many sources not visible using previous technology due to lack of photons reaching the detector will be visible using the invention herein. Clearly, the four point source image of FIG. 6 representing the new design herein is a substantive improvement over the three point source representing the current technology. In both instances, the centroids of the point source locations in the images accurately reflect the locations of the centroids of the actual object point sources. However, by the system herein with a sharper image, the centroid can be more accurately measured.

It will be appreciated that the invention herein will be particularly useful in homeland defense imaging and in medical applications as well as in space. And, of course, modifications of the invention will occur to those skilled in the art. Thus, various grid materials and detector elements are within the skill of the art, as well as means for accomplishing the rotation and translation of the grid plates. Such variations are deemed to be within the scope of this invention.

What is claimed is:

1. In the apparatus for imaging penetrating X rays, gamma rays, and neutrons which includes a first grid plate having an axis of rotation, the first grid plate carrying a first grid; a second grid plate having an axis of rotation coinciding with the axis of rotation of the first grid plate, the second grid plate carrying a second grid aligned with the first grid; means for simultaneously rotating the first and second grid plates and translating the first grid plate relative to the second grid plate; and a detector aligned and rotating with the grids around the axis of rotation, the improvement for achieving enhanced fidelity imaging with only one grid on each grid plate, one grid pair, wherein one of the two grids is provided with (n) slits, the other grid is provided with (n+1) slits of the same width, and wherein the detector includes at least two elements adapted to calculate detected flux.

2. The improvement of claim 1 wherein the detector is aligned with both the real grid and the imaginary grid to act on detected flux.

3. The improvement of claim 1 wherein (n) is an integer between ten and one million, and wherein the number of elements in the detector is two to one hundred one.

4. The improvement of claim 3 wherein the number of elements in the detector is four to seven.

5. The improvement of claim 1 wherein the (n+1) grids are on the grid plate nearest the detector.

6. The improvement of claim 1 wherein the rotation and translation means include gear arrangements affording synchronized rotation of the second grid plate with respect to the first grid plate.

7. The improvement of claim 6 wherein rotation is accomplished by a drive shaft and a drive gear supported in inner and outer support bases so that the first and second grid plates rotate synchronously.

8. The improvement of claim 6 wherein translation is achieved by a precision lead screw in combination with a translating base which carries a recirculating ball bearing assembly.

9. The improvement of claim 1 wherein the second grid plate and the first grid plate are rotatably connected through a plurality of connecting rods, and the second grid plate is rotationally guided by a disk guide when it is rotated by the rods.

10. The improvement of claim 1 wherein the translating, rotating, means are mounted on the side of the apparatus.

11. The improvement of claim 1 wherein the detector is a linear multi-element detector, and wherein the apparatus includes a processor adapted to calculate the flux on each detector element, and to provide an intensity value and location of a peak flux for a given angle and grid separation.

12. The improvement of claim 1 wherein (n) is an even number and the center slit of the grid having (n+1) slits and one of the two center slits of the grid having (n) slits are aligned with the center of the detector.

* * * * *